United States Patent [19]

Boyd

[11] 3,970,817

[45] July 20, 1976

[54] HAZARDOUS LEAKAGE CURRENT PREVENTING FOR REFRACTORY-ENCASED HEATER ELEMENTS

[76] Inventor: Robert Lee Boyd, 103 Ross Drive, Vienna, Va. 22180

[22] Filed: May 14, 1975

[21] Appl. No.: 577,214

[52] U.S. Cl. ..... 219/209; 219/322; 219/544; 338/225; 338/238; 338/243; 338/274

[51] Int. Cl.[2] ..... H05B 1/00

[58] Field of Search ..... 219/209, 322, 511, 363, 219/481, 552, 553, 544; 174/139, 211; 317/9 R, 9 A; 338/35, 224, 225, 238, 243, 274, 277; 29/610–611, 613–614

[56] References Cited

UNITED STATES PATENTS

| | | | |
|---|---|---|---|
| 1,667,960 | 5/1928 | Theis | 219/209 X |
| 1,856,123 | 5/1932 | Auston | 174/139 |
| 1,856,124 | 5/1932 | Auston | 219/209 |
| 2,889,440 | 6/1959 | Reichhelm | 219/552 X |

*Primary Examiner*—C. L. Albritton
*Attorney, Agent, or Firm*—Low & Matthews

[57] ABSTRACT

Low-level "trickle" electric heater means in diverse forms prevents hygroscopic moisture accumulation adjacent relatively open or exposed ends of refractory-encased conventional electrical heating elements, thereby to prevent excessive leakage current through refractory otherwise potentially conductive with moisture buildup which may present a hazard at such time as the element is initially turned on.

15 Claims, 6 Drawing Figures

HAZARDOUS LEAKAGE CURRENT PREVENTING FOR REFRACTORY-ENCASED HEATER ELEMENTS

BACKGROUND OF THE INVENTION

The prevention of undue or excess leakage currents in connection with refractory-encased electric resistance heater elements, such as sheathed tubular heating elements, for example, is a continuing area of concern in the electric appliance industry. Refractory-encased and especially metal-sheathed heater elements are widely used by the public and appear in diverse appliances including electric ranges, electric ovens, hot water heaters and other electrically heated devices.

While the manufacture of such heating elements varies in details of size, termination, etc. for particular applications, the same quite commonly employ an elongated electrical resistance member disposed centrally within and insulated by a compacted monolithic refractory received within an external rigid tubular metal sheath. The resistance member has terminal leads extending from both ends of a sheath length for connection to a supply of electrical energy. Magnesium oxide and like materials are commonly employed as the refractory into which the heating element is embedded.

It is, of course, essential that the electrical resistance element carrying the current be insulated from the surrounding metal sheath which in the instance of an oven or cooking range, for example, is readily accessible to a consumer or contact with a part of the body.

As a consequence, in manufacture, the resistance element is normally maintained substantially centrally or concentrically of the sheath by the refractory, commonly magnesium oxide or the like. While excellent insulation, such material is highly hygroscopic.

As a consequence, in a given environment or over a protracted period of time with ambient conditions of relatively high humidity, moisture in the form of water vapor is attracted to and tends to wick its way into the heater element, thereby promoting a leakage current or mild short circuit path between the end of the terminal and the surrounding sheath. Accordingly, should the moisture buildup become too great, there is a danger of a considerable current leakage between the terminal pin at either end and the surrounding sheath thereby providing significant current flow from the external otherwise cold heater sheath which can cause discomfort or electric shock to an individual accidently touching the same in working around a stove or in handling other appliances such as an electric iron, electric skillet, etc.

In those circuits, such as outdoor circuits, normally protected by ground fault interrupters, the unwanted leakage can build up to be sufficiently excessive to trip the breaker, thus causing unintended interruption or shutdown of service.

SUMMARY OF THE INVENTION

The problem of leakage current control has faced the industry for quite sometime and has received the close attention of the American National Standards Institute, for example, in an effort to provide standards for leakage current for appliances which might be acceptable while remaining within manufacturing practical tolerances.

In 1969, an American National Standards committee determined permissible leakage currents could be no more than .75 milliamps on three wire 120 volt equipment, 20 amp or less, and a maximum of only .5 milliamp on similar equipment that was portable. In general terms, .5 milliamps on a countertop range heater element, for example, is approximately the current which one might respond to abruptly by jerking or tossing a tool or article gripped in the hand in uncontrolled manner.

As a result of my invention, the problem of excess or hazardous leakage current from this source is substantially eliminated at nominal or little cost wherein I have provided a controlled continuous leakage or low-level current flow through a resistance at the dead pin of a heater element of the type contemplated. The constant low level, high resistance current drain through the element when the element is not in use provides sufficient very slight heat so as to drive off and prevent the undesired intrusion of moisture into the cold hygroscopic material of the sheath, whereby at any time the sheath is substantially dry and a substantial leakage current path cannot build up to a dangerous point.

Stated otherwise, in one aspect my invention may be said to provide a controlled leakage at all times in the element which can be predetermined and maintained at a safe level, thereby to preclude and prevent the buildup of unwarranted, unknown and uncontrollable leakage which might present a safety hazard.

DESCRIPTION OF THE DISCLOSED EMBODIMENTS

The present invention may be taken in connection with the accompanying drawings in which FIG. 1 is a diagrammatic illustration of a sheathed heating element in the exemplary form of a heating coil for an oven top range showing the essential electrical connections thereto;

Figure 1:
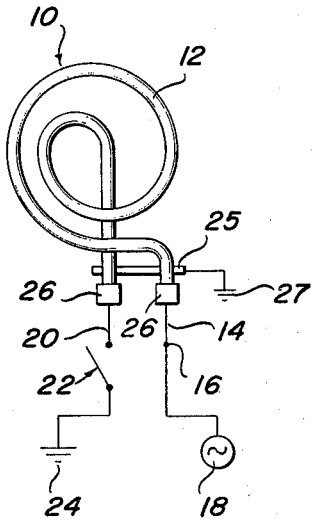

Referring to the drawings, I have shown at 10 in FIG. 1 a sheated tubular heating element of the type with which the invention is associated and which commonly takes many forms in commercial and consumer use. In the exemplary form of FIG. 1, the heating element 10 is shown somewhat diagrammatically as a convoluted coil of the type employed on electric range tops. Such elements commonly include the external metal sheath 12 which is not the primary current conductor but rather the mechanical support of the element. The outer sheath 12 is conventionally grounded as, for example, by a mounting bracket or clip 25 connected at 27 to a suitable ground connection in the installation. Heating is effected by the internal electrical resistance element 14 extending therethrough and normally insulated from the sheath 12 by compacted or fused monolithic refractory 15 of paraclase, magnesiumoxide, or the like, as is well known in the art. As seen in FIG. 1, a given length of the sheathed element 12 includes terminal ends 16, 20 of the resistance element 14 projecting from the sheath for suitable connection to an electrical supply, wherein one lead 16 is connected to a source of electric current at 18 and the other lead 20 is grounded at 24 through an on-off or a rheostat switch 22. This mode of connection contrasts with some usual arrangements wherein the ungrounded conductor is provided with switch means. Of course, for 240 volt service or other ungrounded circuits, the switch as at 22 may be in either live leg or terminal end.

It will be seen that when switch 22 is closed, current flows through the resistance element 14 to heat the same and thereby heat the surrounding sheath to a desired temperature from mildly warm to cherry red as is well known and conventional. The principles noted herein with respect to a conventional range top unit apply equally to other environments in which sheathed or refractory-encased heaters are commonly employed both in industry and consumer environments.

Figure 2:
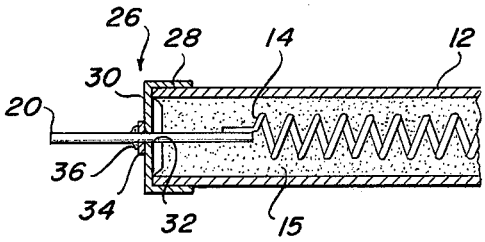
FIG. 2 is a side sectional elevation partly fragmentary of a conventional heater element having one embodiment of the present invention applied thereto.
Figure 3:
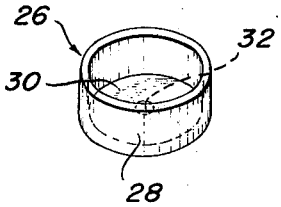
FIG. 3 is a perspective view of the leakage device of the first embodiment of the invention.
Figure 4:
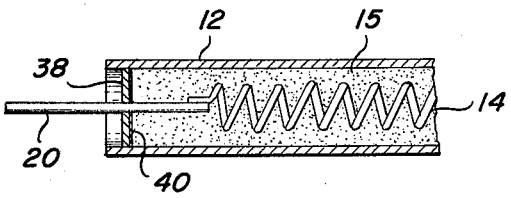
FIG. 4 is a view similar to FIG. 2 showing a second embodiment of the invention.
Figure 6:
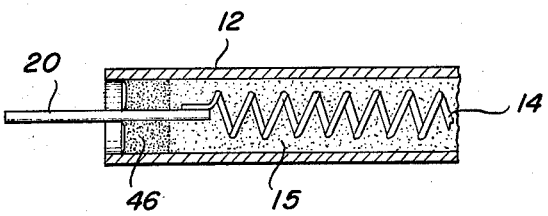
FIG. 6 is a fragmentary side sectional view of a third embodiment of the invention.

With reference to the enlarged end views of the heater element as seen in FIGS. 2, 4 or 6, the compacted hygroscopic refractory material 15 therein commonly extends to or near the top or open end of the sheath from which the terminal end of the resistance element as at 20 extends outwardly. During periods of disuse especially under conditions of high ambient humidity, the inherent hygroscopic nature of the refractory 15 causes moisture to be attracted rather rapidly theretoward and accumulate in the refractory 15 whereby it will be seen with reference to the typical wiring hook-up of FIG. 1 that electrical potential can leak from the resistance element through the moist refractory at the open ends of the sheath, thereby providing live current on the external sheath presenting the shock and discomfort hazard.

In accordance with the present invention and with respect to the first embodiment thereof seen in FIG. 2, I obviate this problem of potentially hazardous leakage current in the provision of a cup-like high resistance element 26 which includes a cylindrical wall member 28, a rear wall 30, and an aperture 32 therethrough.

The element 26 frictionally fits upon the end of the sheath 12 and may be manufactured to conform thereto whether the sheath 12 is circular, triangular, flattened or other form as is conventional in the art.

The element 26 preferably comprises a rigid ceramic member having embedded therein material such as carbon granules to provide a predetermined high resistance thereto on the order of 6,000 to 12,000 ohms. The arrangement might provide on the order of 2 to 4 watts per inch of sheath circumference. The element 26 is quite physically small, extending perhaps one-eighth to one-fourth of an inch along the sheath and may be readily inserted thereupon at the time of manufacture of the sheath or in a field installation as required. In order to ensure proper and full electrical contact between the resistance element 14 and the ceramic resistance 26, a small metal washer 34 may be applied over the terminal 20 and abutted firmly against the resistance 26 and welded as at 36 to the electrical element, thereby both retaining the resistance element on the sheath and providing an area of good electrical contact between the conductor 14 and the resistance element. In like manner a threaded nut may be substituted for the washer.

It should be noted that in actual practice, the element 26 is preferably applied at both ends of the conductor or resistance element 14, as seen in FIG. 1 so that there will be light current flow through the heaters at both ends of the sheath. If the element 26 were applied only to one end of the sheath, for example, adjacent lead 20, the controlled leakage, and heat, would occur only thereat, and the other end, adjacent lead 16 would be without heat. Accordingly, moisture buildup could occur between the terminal 16 and the sheath, although no moisture buildup would occur adjacent lead 20 and the sheath with the member 26 thereat.

Figure 5:
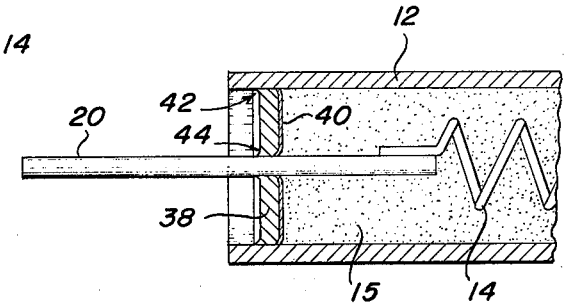
FIG. 5 is an enlarged view of the modification of FIG. 4.

FIG. 4 discloses a modification of the invention wherein in lieu of the cap-like high resistance ceramic element 26, I provide a disc 38 which includes a conductive surface 40 thereon as a metal film or a vapor deposited metal, etc. The disc 38 is suitably apertured and is configured to have a diameter slightly in excess of the internal diameter of the sheath with an aperture slightly smaller than the diameter of the resistance element 14. As a consequence, when the discs 38 with the conductive film 40 thereon are applied axially onto terminals 16 and 20 and into the sheath 12, as seen in the enlarged view of FIG. 5, the inward face 40 thereof is flexed outwardly at 42 toward the metal sheath and inwardly at 44 toward the conductor thereby to establish good electrical contact between the sheath and conductor for the controlled leakage current for the purposes aforesaid. Disc 38 need not be the outermost closure for the sheath. Additional closure of plug means may be employed as is known in the art, or a small amount of additional material 15 may be present in the finished sheath outwardly of disc 38 to fill the same.

In FIG. 6, I show a further modification of the invention wherein neither the cap 26 nor the disc 38 is employed. Rather, in the manufacture of the heating element, the end portion of the sheath at either end thereof is filled with a special modified refractory mix for three-eighths of an inch or so as seen at 46. The refractory mix is enriched with conductive particles such as carbon granules or the like to provide an effective resistance of on the order of 6,000-12,000 ohms in the area 46. As before, the provision of this conductive or resistance area in the otherwise highly insulative refractory provides the controlled leakage referred to thereby to prevent any hygroscopic buildup of moisture in either exposed end of the heating element.

In any form of the invention, it will be seen that the modification of the element is not only relatively simple, but is permanent in nature, remaining effective even if the heating element is removed and reinstalled similarly in a like installation.

As a further alternative, and of somewhat different character, a separately energized external heater may be employed having the configuration of cap 26, for example, but with separate leads, and which may be retained upon the terminal lead by a fastener such as a Tinnerman nut. Other variants may occur to those skilled in the art within the spirit and scope of the invention.

What I claim is:

1. A leakage current protective device for refractory-encased electric heating elements comprising a controlled resistance extending between a resistance heating element and a ground connection adjacent the refractory encasing said element, thereby to provide low current flow therethrough with resultant low heat to drive off moisture attracted to said refractory.

2. A leakage current protective device for an elongated sheathed tubular electric heating element of the type wherein a resistance heating member is disposed substantially centrally of an externally grounded sheath and within a hygroscopic refractory material, the protective device comprising:

controlled resistance means providing predetermined electrical resistance adjacent one end of said sheath, said controlled resistance means extending between and interconnecting said heating member and said sheath, thereby to permit low current flow through said heating member to the connection with said controlled resistance means and therethrough to said sheath, thereby to provide a temperature in said controlled resistance means at the sheath ends sufficient to drive off attracted moisture from the refractory.

3. The leakage current protective device of claim 2 wherein said controlled resistance means comprises a cap-like member enclosing the end of the sheath, said member frictionally gripping said sheath for electrical contact thereat, and, said cap being apertured to receive said heating member therethrough and in electrical contact therewith.

4. The leakage current protective device of claim 3 further including metallic washer means secured to said controlled resistance means and mechanically retaining said cap on said sheath while improving heater member electrical contact therewith.

5. The leakage current protective device of claim 2 wherein said controlled resistance means comprises a disc frictionally fitted within said sheath, said disc having an outside dimension slightly greater than the inside dimension of said sheath, and having a central aperture slightly less in diameter than said heater member, thereby causing said disc to tightly frictionally engage both said sheath and said heater member for mechanical retention and good electrical contact.

6. The leakage current protective device of claim 5 wherein the inside face of said disc is covered with a resistance material.

7. The leakage current protective device of claim 2 wherein said controlled resistance means comprises a modified refractory mix adjacent the sheath end.

8. The leakage current protective device of claim 7 wherein said modified mix extends inwardly a distance on the order of one-fourth to one-half inch.

9. The leakage current protective device of claim 2 wherein said controlled resistance means permits current flow no greater than 0.5 milliamp in a 120 volt circuit when said heating member is normally deenergized from active use.

10. The leakage current protective device of claim 2 wherein said controlled resistance means permits a power drain on the order of 2 to 4 watts per inch of sheath circumference.

11. The leakage current protective device of claim 2 wherein said controlled resistance means is on the order of 6000–12000 ohms.

12. The leakage current protective device of claim 2 wherein said resistance means is provided adjacent each end of said sheath.

13. A leakage current protective device for a heating element having a refractory-encased heating resistance members, comprising an electrically energized auxiliary low level heater affixed to said element thereby to drive off moisture attracted to said refractory.

14. The leakage current protective device of claim 13 wherein said heater is affixed to said element adjacent the end thereof.

15. A leakage current protective device for an elongated sheathed tubular electric heating member wherein a resistance heating element is disposed substantially centrally of an external sheath and within a hygroscopic refractory material comprising:

controlled resistance means providing predetermined electrical resistance adjacent each end of said sheath, said controlled resistance means being energized by a circuit whereby the current flows at all times through it, thereby to permit low current flow at all times through said controlled resistance means, thereby to provide a temperature at the sheath ends sufficient to drive off attracted moisture from the refractory.

* * * * *